US006222489B1

(12) United States Patent
Tsuru et al.

(10) Patent No.: US 6,222,489 B1
(45) Date of Patent: Apr. 24, 2001

(54) ANTENNA DEVICE

(75) Inventors: Teruhisa Tsuru, Kameoka; Harufumi Mandai, Takatsuki; Koji Shiroki; Kenji Asakura, both of Shiga-ken; Seiji Kanba, Otsu, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/525,821

(22) Filed: Mar. 15, 2000

Related U.S. Application Data

(63) Continuation-in-part of application No. 09/225,600, filed on Jan. 6, 1999, and a continuation-in-part of application No. 08/693,447, filed on Aug. 7, 1996, now Pat. No. 6,052,096.

(30) Foreign Application Priority Data

Aug. 7, 1995 (JP) ..... 7-201153
Jan. 6, 1998 (JP) ..... 10-883

(51) Int. Cl.[7] ..... H01Q 1/36

(52) U.S. Cl. ..... 343/700 MS; 343/787; 343/873; 343/895

(58) Field of Search ..... 343/700 MS, 702, 343/787, 873, 895, 788, 795, 846, 848; H01Q 1/36, 1/38, 1/40

(56) References Cited

U.S. PATENT DOCUMENTS 4,728,962 * 3/1988 Kitsuda et al. ..... 343/872
5,861,852 * 1/1999 Asakura et al. ..... 343/702
5,973,651 * 10/1999 Suesada et al. ..... 343/752
5,977,927 * 11/1999 Mandai et al. ..... 343/788
6,052,096 * 4/2000 Tsuru et al. ..... 343/787

* cited by examiner

*Primary Examiner*—Tho Phan
(74) *Attorney, Agent, or Firm*—Ostrolenk, Faber, Gerb & Soffen, LLP

(57) ABSTRACT

An antenna device, comprising an antenna unit including basic body comprising at least one of dielectric ceramic and magnetic ceramic, at least one conductor disposed at least one of inside and on a surface of the basic body, and a feeding electrode for applying a voltage to the conductor disposed on the surface of the basic body; a mounting board on which the antenna unit is mounted; a ground part in association with the mounting board and adapted to resonate with the antenna unit; and a length in the polarization direction of a radio wave of the ground part being about $\lambda/4$ or more, where $\lambda$ is a wavelength of the radio wave, the basic body comprising a first generally planar sheet having a plurality of spaced, first conductors formed on one major surface thereof and a second generally planar sheet having a plurality of spaced second conductors formed on one major surface thereof; the first and second generally planar sheets being laminated together to form an elongated structure wherein respective pairs of the first and second conductors are coupled to one another to form respective spiral loops of a spiral antenna so that a central axis of the spiral antenna extends generally parallel to a longitudinal direction of the elongated structure; each of the sheets being formed of a material having a permeability of $1<\mu<7$ or a dielectric constant $\epsilon$ of $1<\epsilon<130$; and a feeding terminal coupled to one end of the spiral antenna so that the antenna unit forms a mono-pole antenna, the antenna unit and the ground part together functioning as a dipole antenna.

7 Claims, 6 Drawing Sheets

ANTENNA DEVICE

CROSS REFERENCE TO RELATED APPLICATIONS

This application is a continuation-in-part of U.S. application Ser. No. 09/225,600, filed Jan. 6, 1999 and a continuation-in-part of U.S. application Ser. No. 08/693,447 filed Aug. 7, 1996, now U.S. Pat. No. 6,052,096 the disclosures of which are hereby incorporated by reference in their entireties.

BACKGROUND OF THE INVENTION

1. Field of the Invention

The present invention relates to antenna devices and chip antennas. In particular, the present invention relates to an antenna device used for mobile communication, cellular communication, local area networks (LAN), television, radio, etc. Further, the present invention makes use of a chip antenna of small size, itself a monopole antenna, which, together with a ground part, functions like a dipole antenna, even though it is of small size.

2. Description of the Related Art

FIG. 3 shows a prior art monopole antenna 50. The monopole antenna 50 has a conductor 51, one end 52 of the conductor 51 being a feeding point and the other end 53 being a free end in the air (dielectric constant $\epsilon$=1 and relative permeability $\mu$=1).

Because the conductor of the antenna is present in the air in linear antennas, such as the prior monopole antenna 50, the size of the antenna conductor becomes larger. For example, when the wavelength in the vacuum is $\lambda_0$ in the monopole antenna 50, the length of the conductor 51 must be $\lambda_0/4$. Thus, such an antenna cannot be readily used for mobile communication or the like which requires a compact antenna.

Conventionally, as a small-sized antenna to be used in a radio equipment, an inverted F-type antenna is known. One example of an inverted F-type antenna is explained in reference to FIG. 11. The inverted F-type antenna 50 is composed of a printed-circuit board 52 which is made of a glass-filled epoxy resin of a relative dielectric constant of 4 to 5 and on a surface of which a ground electrode 51 connected to the ground electric potential is provided, and a radiator plate 53 which is made of a metal plate arranged in parallel with the printed circuit board 52 and above the printed-circuit board 52. The radiator plate 53 fulfills the function of radiating a radio wave, and its length is $\lambda/4$ ($\lambda$: wavelength of the radio wave). On the side edge of the radiator plate 53, a short pin 54 extended toward the printed-circuit board 52 is integrally provided with the radiator plate 53. The short pin 54 is electrically connected to the ground electrode 51 on the printed-circuit board 52. That is, the radiator plate 53 is short-circuited to the ground electrode 51 through the short pin 54. On the printed-circuit board 52, a coaxial cable connection portion 52*a* is provided, and to the coaxial cable connection portion 52*a* a coaxial cable, a connector, etc. (not illustrated) through which a load dispatching to the radiator plate 53 takes place, are connected through a connection terminal 53*a* led out from the radiator plate 53.

However, in the above described inverted F-type antenna, there were cases, in which in order to realize a small-sized antenna, a dielectric substance is inserted between the ground electrode on the printed-circuit board and the radiator plate, and the wavelength shortening effect of the dielectric substance is used. In these cases there is a problem that the antenna gain is decreased because of the effect of the dielectric substance.

SUMMARY OF THE INVENTION

It is an object of the present invention to provide an antenna device which can be used for mobile communication, having small size and high gain.

In accordance with the present invention, an antenna device is provided comprising an antenna unit including a basic body comprising at least one of dielectric ceramic and magnetic ceramic, at least one conductor disposed at least one of inside and on a surface of the basic body, and a feeding electrode for applying a voltage to the conductor, disposed on the surface of the basic body, a mounting board on which said antenna unit is mounted, a ground part in association with said mounting board and adapted to resonate with said antenna unit; and a length in the polarization direction of a radio wave of said ground part being about $\lambda/4$ or more, where $\lambda$ is a wavelength of the radio wave, said basic body comprising; a first generally planar sheet having a plurality of spaced, first conductors formed on one major surface thereof, a second generally planar sheet having a plurality of spaced second conductors formed on one major surface thereof, said first and second generally planar sheets being laminated together to form an elongated structure wherein respective pairs of said first and second conductors are coupled to one another to form respective spiral loops of a spiral antenna so that a central axis of said spiral antenna extends generally parallel to a longitudinal direction of said elongated structure, each of said sheets being formed of a material having a relative permeability of $1<\mu<7$ or a dielectric constant $\epsilon$ of $1<\epsilon<130$; and a feeding terminal coupled to one end of said spiral antenna so that said antenna unit forms a mono-pole antenna, said antenna unit and said ground part together functioning as a dipole antenna.

The at least one conductor comprises a metal mainly containing any one of copper, nickel, silver, palladium, platinum, or gold.

The antenna unit in accordance with an embodiment of the present invention has a wavelength shortening effect because the base member is formed of either a material having a dielectric constant $\epsilon$ of $1<\epsilon<130$ or a material having a relative permeability $\mu$ of $1<\mu<7$.

Further, the antenna unit in accordance with another embodiment of the present invention enables monolithic sintering of the conductive pattern composed of a base member and a conductor, because the conductive pattern is formed of a metal mainly containing any one of copper(Cu), nickel (Ni), silver (Ag), palladium (Pd), platinum (Pt), or gold (Ag).

In the above described antenna device, the ground part may comprise at least one of a ground electrode disposed on the mounting board and a ground portion of a high-frequency circuit portion mounted on the mounting board together with the antenna unit.

According to the above described structure and arrangement, because the antenna device comprises an antenna unit and a ground part resonant with the antenna unit having $\lambda/4$ as the length in the polarization direction of a radio wave, the antenna unit is able to function as one pole of a dipole antenna and the ground part resonant with the antenna unit is able to function as the other pole of the dipole antenna. Therefore, at a resonant point, the antenna unit and ground part are able to act as a pair of antennas like a dipole antenna. As the result, an antenna device having as high a gain like a dipole antenna is made available although the antenna device is small-sized.

Further, a radio equipment mounted with such a small-sized antenna device having a high gain is also able to be made of small size and of a high gain.

Other features and advantages of the present invention will become apparent from the following description of the invention which refers to the accompanying drawings.

DETAILED DESCRIPTION OF EMBODIMENTS OF THE INVENTION

Figure 1:
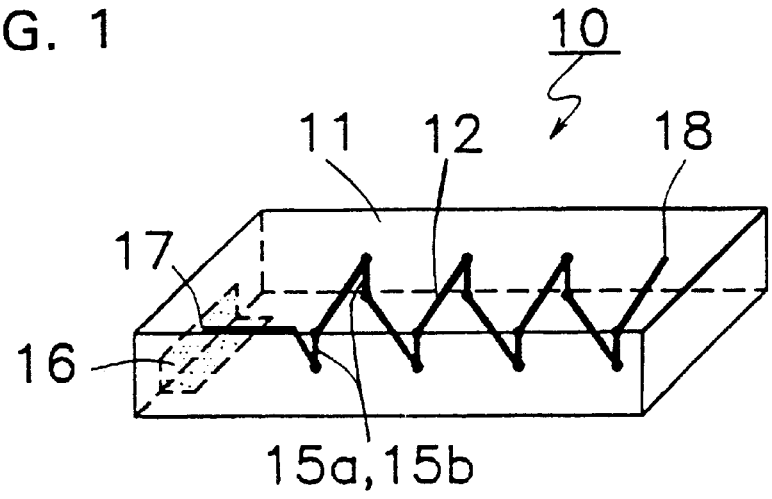
FIG. 1 is an isometric view illustrating an embodiment of a chip antenna in accordance with the present invention.
Figure 2:
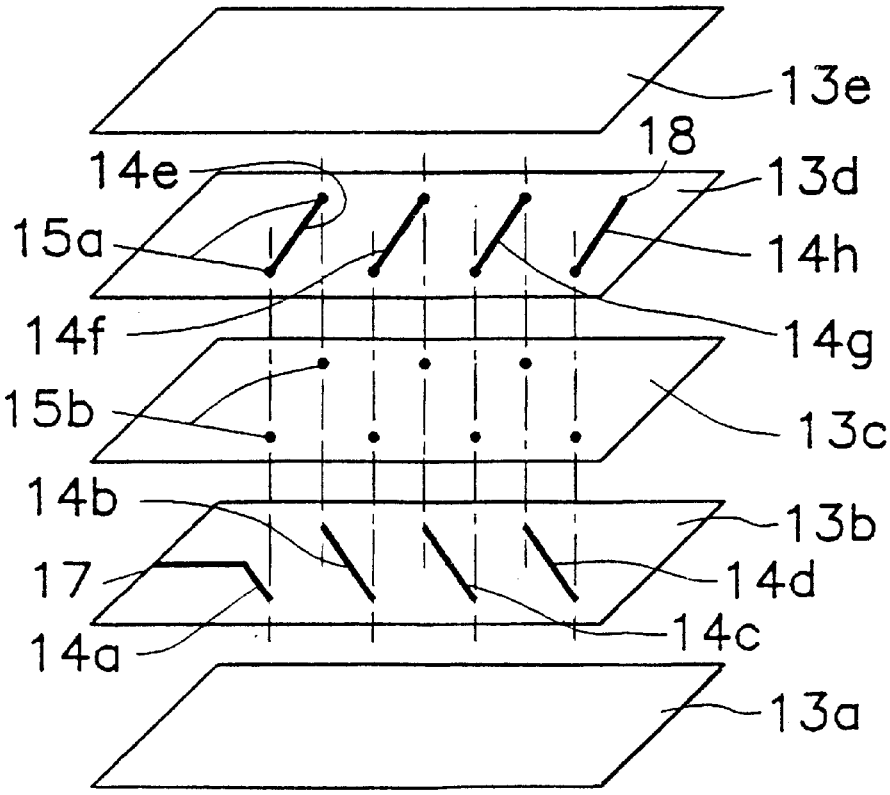
FIG. 2 is an exploded isometric view of FIG. 1.
Figure 3:
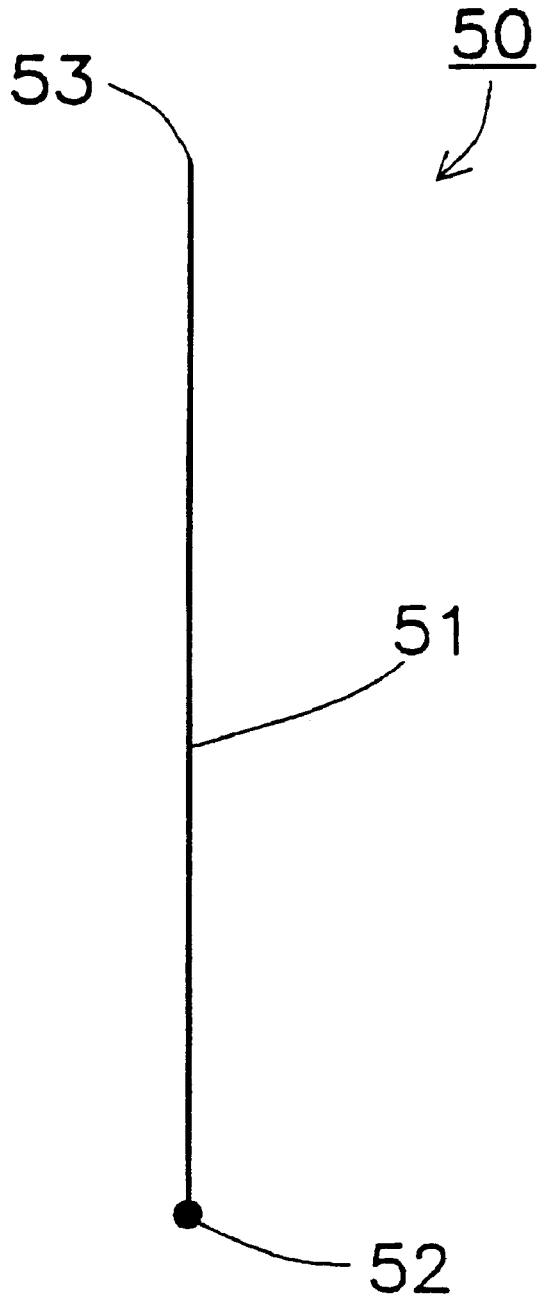
FIG. 3 PRIOR ART
FIG. 3 is a prior art monopole antenna.

FIGS. 1 and 2 are an isometric view and an exploded isometric view illustrating an embodiment of a chip antenna 10 in accordance with the present invention.

The chip antenna 10 comprises a conductor 12 which is spiraled along the longitudinal direction in a rectangular dielectric base member 11. The dielectric base member is formed by laminating rectangular sheets 13*a*–13*e*, each having a dielectric constant of 2 to 130, or having a relative permeability of 2 to 7, as shown in Tables 1 and 2.

TABLE 1

| No. | Composition | Dielectric Constant | Q · f |
|---|---|---|---|
| 1 | Bi-Pb-Ba-Sm-Ti-O | 130 | 1,000 |
| 2 | Bi-Pb-Ba-Nd-Ti-O | 110 | 2,500 |
| 3 | Pb-Ba-Nd-Ti-O | 90 | 5,000 |
| 4 | Ba-Nd-Ti-O | 60 | 4,000 |
| 5 | Nd-Ti-O | 37 | 8,000 |
| 6 | Mg-Ca-Ti-O | 21 | 20,000 |
| 7 | Mg-Si-O | 10 | 80,000 |
| 8 | Bi-Al-Si-O | 6 | 2,000 |
| 9 | (Ba-Al-Si-O) + Teflon ® Polytetrafluoroethylene Resin | 4 | 4,000 |
| 10 | Teflon ® Polytetrafluoroethylene Resin | 2 | 10,000 |

TABLE 2

| No. | Composition | Relative Permeability | Threshold Frequency |
|---|---|---|---|
| 11 | Ni/Co/Fe/O = 0.49/0.04/0.94/4.00 | 7 | 130 MHZ |
| 12 | Ni/Co/Fe/O + 0.47/0.06/0.94/4.00 | 5 | 360 MHZ |
| 13 | Ni/Co/Fe/O + 0.45/0.08/0.94/4.00 | 4 | 410 MHZ |
| 14 | (Ni/Co/Fe/O + 0.45/0.08/0.94/4.00) + Teflon | 2 | 900 MHZ |

In Tables 1 and 2, the sample having a dielectric constant of 1 and a relative permeability of 1 is not selected because the sample is electrically identical to the prior art antenna.

The Q·f in Table 1 represents the product of the Q value and a measuring frequency and is a function of the material. The threshold frequency in Table 2 represents the frequency that the Q value is reduced by half to an almost constant Q value at a low frequency region, and represents the upper limit of the frequency applicable to the material.

At the surface of the sheet layers 13*b* and 13*d* of the sheet layers 13*a* through 13*e*, each of which has a dielectric constant $\epsilon$ of $1<\epsilon<130$ or a relative permeability $\mu$ of $1<\mu<7$, linear conductive patterns 14*a* through 14*h* comprising a metal mainly containing Cu, Ni, Ag, Pd, Pt or Au are provided by printing, evaporating, laminating or plating, as shown in Table 3. In the sheet layer 13*d*, a via hole 15*a* is formed at both ends of the conductive patterns 14*e* through 14*g* and one end of the conductive pattern 14*h*. Further, in the sheet layer 13*c*, a via hole 15*b* is provided at the position corresponding to the via hole 15*a*, in other words, at one end of the conductive pattern 14*a* and at both ends of the conductive patterns 14*b* through 14*d*. A spiral conductor 12 having a rectangular cross-section is formed by laminating the sheet layers 13*a* through 13*e* so that the conductive patterns 14*a* through 14*h* come in contact with via holes 15*a*, 15*b*. In material Nos. 1 to 8 and Nos. 11 to 13 (Tables 1 and 2), the chip antenna 10 is made by monolithically sintering the base member 11 and the conductive patterns 14*a* through 14*h* under the conditions shown in Table 3. On the other hand, such a sintering process is not employed in material Nos. 9, 10 and 14 each containing a resin.

TABLE 3

| Metal Temperature | Material No. | Sintering Atmosphere | Sintering |
|---|---|---|---|
| Cu | 8 | Reductive | ≦1,000° C. |
| Ni | 7 | Reductive | 1,000 to 1,200° C. |
| Ag-Pd alloy | 1, 2, 3, 4, 5, 11, 12 | Air | 1.000 to 1,250° C. |
| Pt | 6 | Air | ≦1,250° C. |
| Ag | 9, 11, 14 | | Not Sintered |

Each material No. in Table 3 is identical to that in Tables 1 and 2.

One end of the conductor 12, i.e., the other end of the conductive pattern 14*a*, is brought to the surface of the dielectric base member 11 to form a feeding end 17 which connects to a feeding terminal 16 for applying a voltage to the conductor 12, and the other end, i.e., the other end of the conductive pattern 14*h*, forms a free end 18 in the dielectric base member 11.

Table 4 shows relative bandwidth at the resonance point of the chip antenna 10 when using various materials as the sheet layers 13*a* through 13*e* comprising the base member 11. The relative bandwidth is determined by the equation: relative bandwidth [%]=(bandwidth [GHz]/center frequency [GHz]) 100. The chip antennas 10 for 0.24 GHz and 0.82

GHz are prepared by adjusting the turn numbers and length of the conductor 12.

TABLE 4

| Material No. | 0.24 GHz | Relative Bandwidth 0.82 GHz |
|---|---|---|
| 1 | Not measurable | Not measurable |
| 2 | 1.1 | 1.0 |
| 3 | 1.7 | 1.5 |
| 4 | 2.4 | 2.3 |
| 5 | 2.9 | 2.7 |
| 6 | 3.1 | 3.0 |
| 7 | 3.5 | 3.3 |
| 8 | 3.8 | 3.4 |
| 9 | 4.1 | 3.7 |
| 10 | 4.5 | 4.3 |
| 11 | Not measurable | Not measurable |
| 12 | 2.5 | 2.4 |
| 13 | 3.0 | 2.7 |
| 14 | 3.2 | 3.0 |

Each material No. in Table 4 is identical to that in Tables 1 and 2. In Table 4, Not Measurable means a relative bandwidth of 0.5 [%] or less, or a too small resonance to measure.

Results in Table 4 demonstrate that chip antennas using a material having a dielectric constant of 130 (No. 1 in Table 1) and a material having a relative permeability of 7 (No. 11 in Table 2) do not exhibit antenna characteristics, as shown as "Not Measurable". On the other hand, when the dielectric constant is 1 or the relative permeability is 1, no compact chip antenna is achieved by the wavelength shortening effect due to the same value as the air. Thus, suitable materials have a dielectric constant $\epsilon$ of $1<\epsilon<130$, or a relative permeability $\mu$ of $1<\mu<7$.

At a resonance frequency of 0.82 GHz, the size of the chip antenna 10 is 5 mm wide, 8 mm deep, and 2.5 mm high, and approximately one-tenth of the size of the monopole antenna 50, approximately 90 mm.

In the embodiment set forth above, the size of the chip antenna can be reduced to approximately one-tenth of the prior art monopole antenna while satisfying antenna characteristics, by using a material of 1<dielectric constant <130 or 1<relative permeability<7. Thus, a compact antenna with sufficiently satisfactory antenna characteristics can be prepared. Further, since the conductive pattern composed of the base member and conductor can be monolithically sintered, the production process can be simplified and cost reduction can be achieved.

In the embodiment set forth above, several materials are used as examples, but the embodiment is not to be limited thereto.

Further, although the embodiment set forth above illustrates an antenna having one conductor, two or more conductors may be available.

Figure 4:
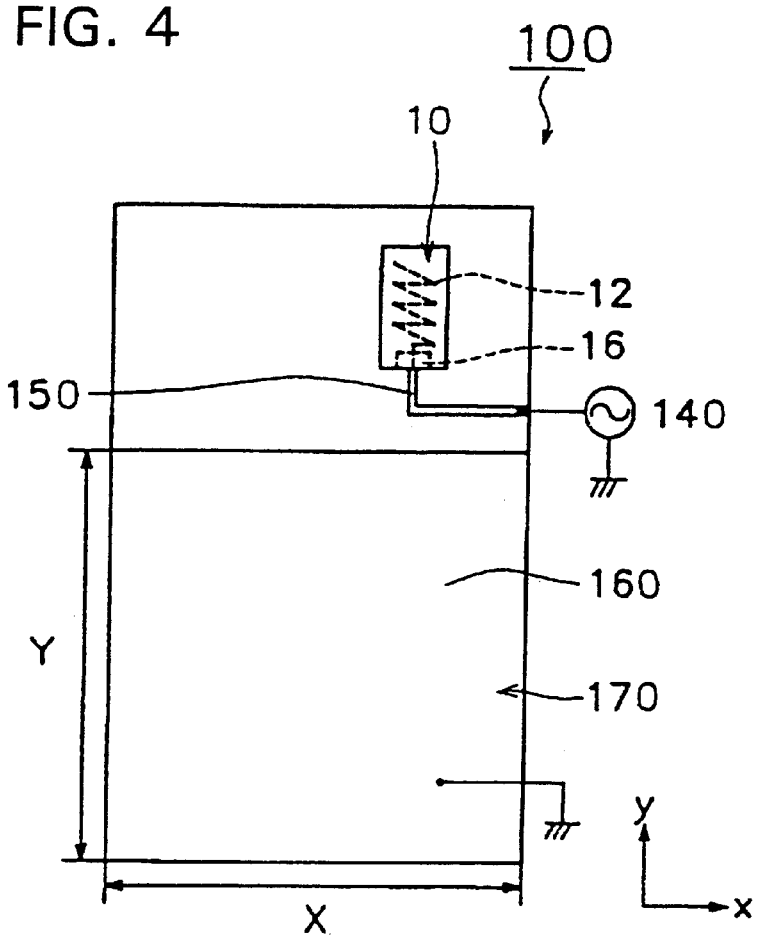
FIG. 4 is a top view of a first preferred embodiment relating to an antenna device of the present invention.

Referring to FIG. 4, a preferred embodiment of an antenna device 100 comprises an antenna unit 10 having a conductor 12 and a feeding electrode 16 connected to one end of the conductor 12, a power supply 140 connected to the feeding electrode 16, and a mounting board 170 having a linear conductor pattern 150 formed by printing conductive material on the surface and a ground electrode 160 of substantially rectangular shape.

Further, the antenna unit 10 is mounted on the mounting board 170, and the feeding electrode 16 on the antenna unit 10 and the power supply 140 are connected through the conductor pattern 150 on the surface of the mounting board 170. The ground electrode 160 on the surface of the mounting board 170 becomes a ground part resonant with the antenna unit 10. The length in the polarization direction of a radio wave (horizontally polarized wave: direction x in FIG. 4, vertically polarized wave: direction y in FIG. 4) of the ground electrode 160 on the surface of the mounting board 170 as the ground part is $\lambda/4$ or more ($\lambda$: wavelength of a radio wave).

According to the above described structure and arrangement, the antenna unit 10 comes to function as one pole of a dipole antenna, and the ground electrode 160 on the surface of the mounting board 170 as the ground part resonant with the antenna unit 10 comes to function as the other pole of the dipole antenna.

Figure 5:
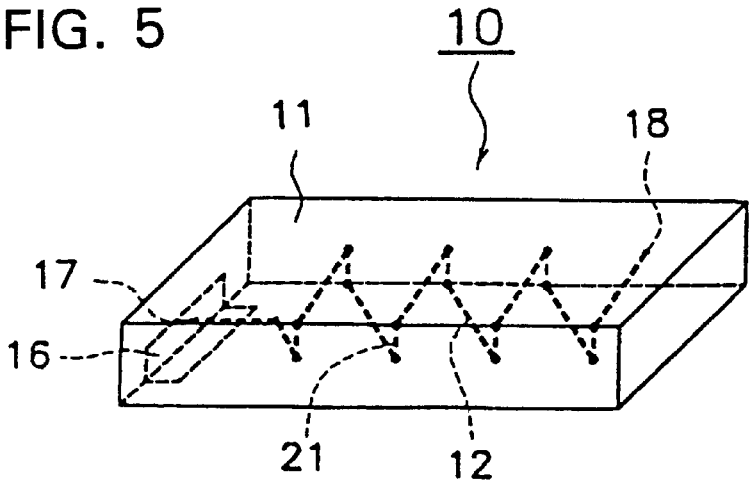
FIG. 5 is a perspective view of an antenna unit constituting the antenna device in FIG. 4.

As shown in FIG. 5, like the chip antenna of FIG. 1, the antenna unit 10 is composed of a basic body of a rectangular solid, a conductor 12 spirally wound in the longitudinal direction of the basic body 11 inside the basic body 11, and a feeding electrode 16 for applying a voltage to the conductor 12, provided on the surface of the basic body 11.

Figure 6:
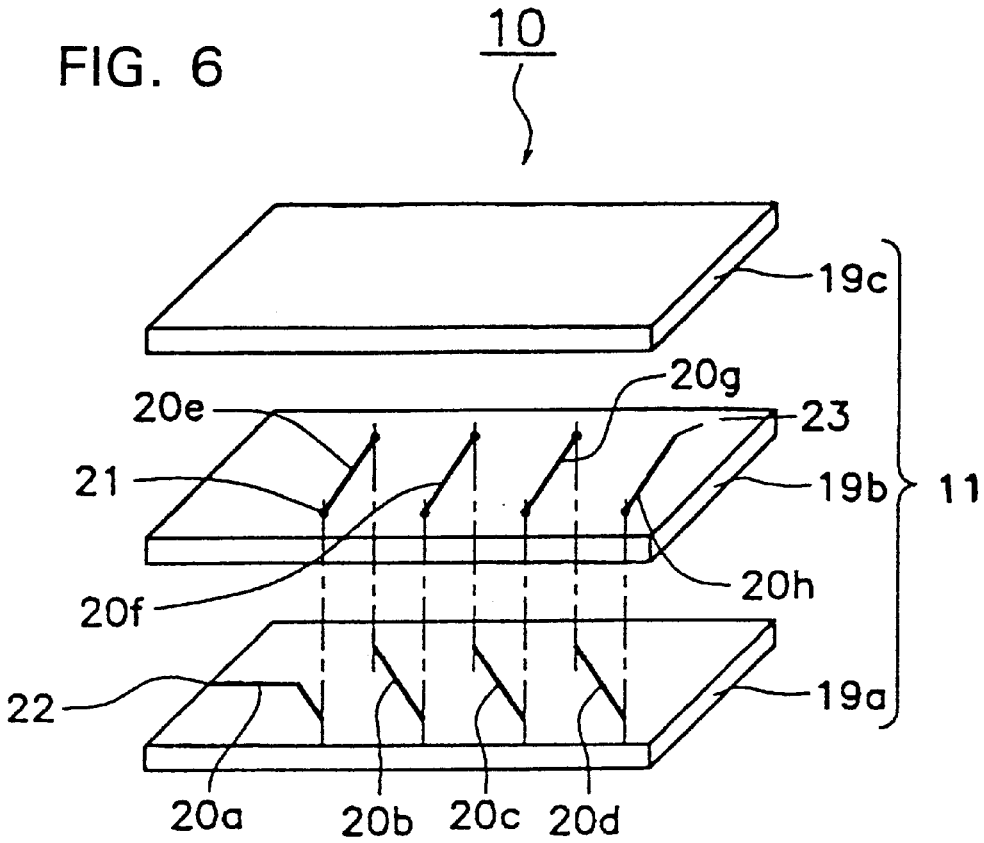
FIG. 6 is an exploded perspective view of the antenna unit in FIG. 5.

In FIG. 6, an exploded perspective view of the antenna unit 10 of FIG. 5 is shown. The basic body 11 is composed of rectangular thin layers 19*a* through 19*c* laminated which are made of dielectric ceramic having barium oxide, aluminium oxide, silica as its main components. Out of these thin layers, on the surface of the thin layers 19*a*, 19*b* substantially L-shaped or substantially straight conductor patterns 20*a* through 20*h* of copper or copper alloy are formed by screen printing, evaporation, or plating. At fixed positions (both ends of conductor patterns 20*e* through 20*g*, one end of conductor pattern 20*h*), via holes are formed in the thickness direction.

Further, after the thin layers 19*a* through 19*c* have been laminated and conductor patterns 20*a* through 20*h* have been connected by way of via holes 21, a conductor 12 spirally wound in the longitudinal direction of the basic body 11 inside the basic body 11 is formed by sintering.

One end of the conductor 12 (one end of conductor pattern 20*a*) led out to the end surface of the basic body 11 constitutes a power supply portion 22 and is connected to a feeding electrode 16 disposed on the surface of the basic body 11. The other end of the conductor 12 (the other end of conductor pattern 20*h*) constitutes an open end 23 inside the basic body 11.

Figure 7:
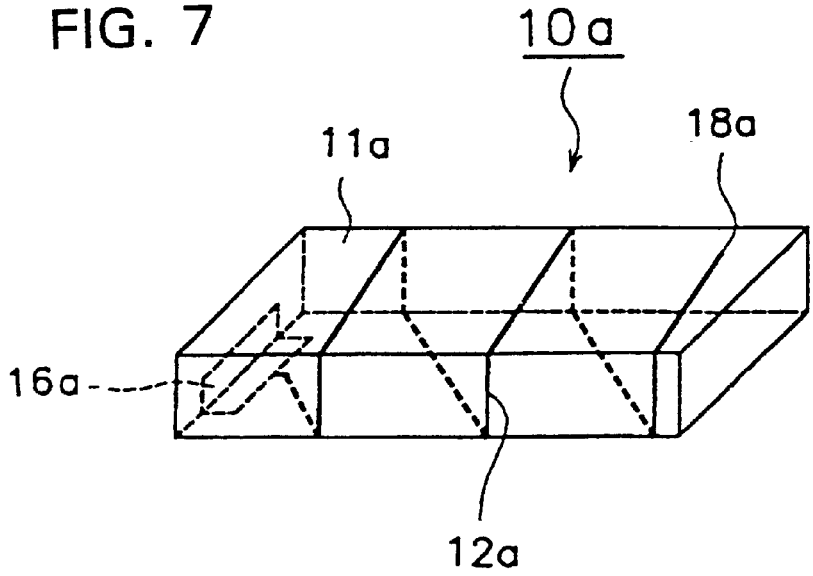
FIG. 7 is a perspective view showing a modification of the antenna unit in FIG. 5.
Figure 8:
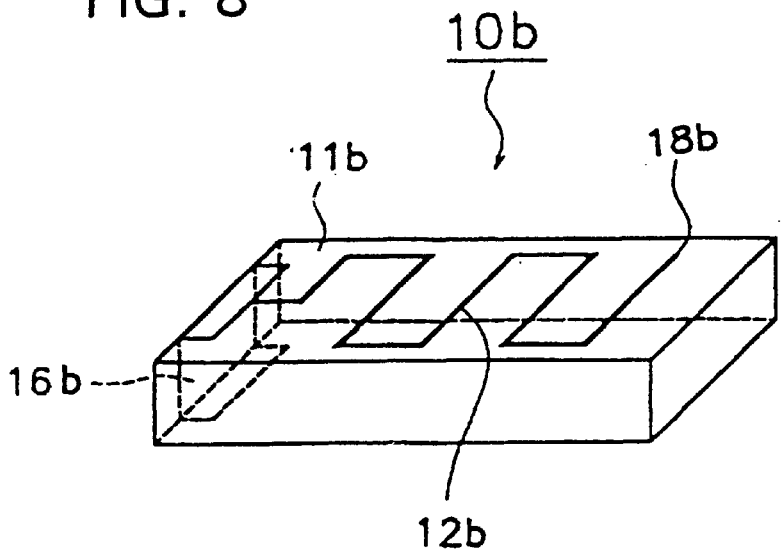
FIG. 8 is a perspective view showing another modification of the antenna unit in FIG. 5.

In FIGS. 7 and 8, perspective views of modifications of the antenna unit 10 in FIG. 5 are shown. In an antenna unit 10*a* in FIG. 7, a basic body 11*a* of a rectangular solid, a conductor 12*a* spirally wound in the longitudinal direction of the basic body 11*a* along the surface of the basic body 11*a*, and a feeding electrode 16*a* disposed on the surface of the basic body 11*a* are shown. One end of the conductor 12*a* is connected to the feeding electrode 16*a* for applying a voltage to the conductor 12*a* on the surface of the basic body 11*a*. Further, the other end of the conductor 12*a* constitutes an open end 18*a* on the surface of the basic body 11*a*. According to the antenna unit 10*a* constructed in this way, because the conductor 12*a* is able to be easily formed by screen printing, etc. in a spiral way on the surface of the basic body 11*a*, the manufacturing processes of the antenna unit 10*a* can be simplified.

In the antenna unit 10*b* in FIG. 8, a basic body 11*b* of a rectangular solid, a conductor 12*b* meanderingly provided on the surface of the basic body 11*b*, and a feeding electrode 16*b* formed on the surface of the basic body 11*b* are provided. One end of the conductor 12*b* is connected to the feeding electrode 16*b* for applying a voltage to the conductor 12*b* on the surface of the basic body 11*b*. The other end of the conductor 12*b* constitutes an open end 18*b* on the surface of the basic body 11*b*. According to the antenna unit

10*b* constructed in this way, because the conductor 12*b* is meanderingly provided on only one major surface of the basic body 11*b*, it becomes possible to lower the height of the basic body 11*b* and it becomes possible to lower the height of the antenna unit 10*b* accordingly. Further, even if the conductor 12*b* of a meandering shape is provided inside the basic body 11*b*, the same effect can be obtained.

Here, the maximum gain (dBd) practically measured using the antenna device 10 (FIG. 4) is shown in Table 5. At this time, an antenna unit having the dimensions of 8 mm (transverse)×5 mm (longitudinal)×2.5 mm(height) was used, and by changing the transverse length (X in FIG. 4) and the longitudinal length (Y in FIG. 4) of the ground electrode 160 as the ground part of the antenna unit 10, the change of the maximum gain (dBd) of a horizontally polarized wave (polarized wave in the direction of X in FIG. 4) and a vertically polarized wave (polarized wave in the direction of Y in FIG. 4) was investigated.

TABLE 5

| X | Y | Horizontal polarized wave maximum gain [dBd] | Vertically polarized wave maximum gain [dBd] |
|---|---|---|---|
| λ/8 | λ8 | −8.9 | −7.2 |
| λ/8 | 3λ/16 | −8.4 | −3.6 |
| λ/8 | λ/4 | −8.3 | −0.8 |
| λ/8 | 5λ/16 | −7.6 | −0.2 |
| 3λ/16 | λ/8 | −6.5 | −7.7 |
| 3λ/16 | 3λ/16 | −6.6 | −3.5 |
| 3λ/16 | λ/4 | −6.1 | −0.8 |
| 3λ/16 | 5λ/16 | −5.2 | −0.3 |
| λ/4 | λ/8 | −0.8 | −7.0 |
| λ/4 | 3λ/16 | −0.9 | −3.4 |
| λ/4 | λ/4 | −0.8 | −1.0 |
| λ/4 | 5λ/16 | −0.8 | −0.1 |
| 5λ/16 | λ/8 | −0.4 | −6.9 |
| 5λ/16 | 3λ/16 | −0.5 | −3.6 |
| 5λ/16 | λ/4 | −0.4 | −0.5 |
| 5λ/16 | 5λ/16 | −0.4 | −0.3 |

According to Table 5, it is understood that by making the length in the polarization direction of a radio wave of the ground electrode X (transverse) for horizontally polarized wave, Y (longitudinal) for vertically polarized wave in FIG. 4) λ/4 or more (λ: wavelength of a radio wave), the maximum gain of a horizontally polarized wave and vertically polarized wave becomes −1.0 (dBd) or more, that is, as much as that of a dipole antenna, and the antenna device 100 (FIG. 4) has a high gain. Further, the length of λ/4 means about 40 mm for a radio wave of 1.9 GHz.

Figure 9:
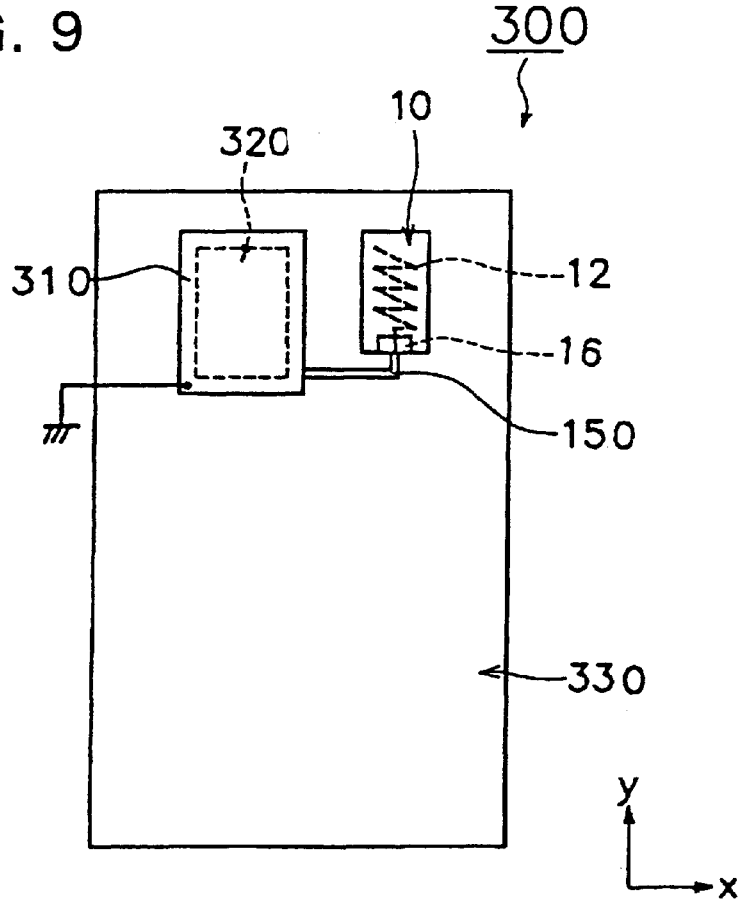
FIG. 9 is a top view of a second preferred embodiment relating to an antenna device of the present invention.

In FIG. 9, a top view of a second preferred embodiment of an antenna device according to the present invention is shown. The antenna device 300 is composed of an antenna unit 10 having a conductor 12 and a feeding electrode 16 with one end of the conductor 12 connected, a high-frequency circuit portion 320 with the feeding electrode 16 connected and with a ground portion 310 made of a metal chassis, and a mounting board 330 having a linear conductor pattern 150 formed by printing conductive material on the surface.

Further, the antenna unit 10 and the high-frequency circuit portion 320 are mounted on the mounting board 330, and the feeding electrode 16 of the antenna unit 10 and the high-frequency circuit portion 320 are connected through the conductor pattern 150 on the surface of the mounting board 330. The ground portion 310 of the high-frequency circuit portion 320 mounted on the mounting board 330 constitutes a ground part resonant with the antenna unit 10. Moreover, the length in the polarization direction of a radio wave of the ground portion 310 as the ground part, of the high-frequency circuit portion 320 has been more than λ/4 (λ: wavelength of a radio wave) (horizontally polarized wave: direction x in FIG. 9, vertically polarized wave: direction y in FIG. 9).

According to the antenna device 300 constructed in the above described way, the antenna unit 10 comes to act as one pole of a dipole antenna, and the ground portion 310 of the high-frequency circuit portion 320 in the function of the ground part resonant with the antenna unit 10 as the other pole of the dipole antenna.

Figure 10:
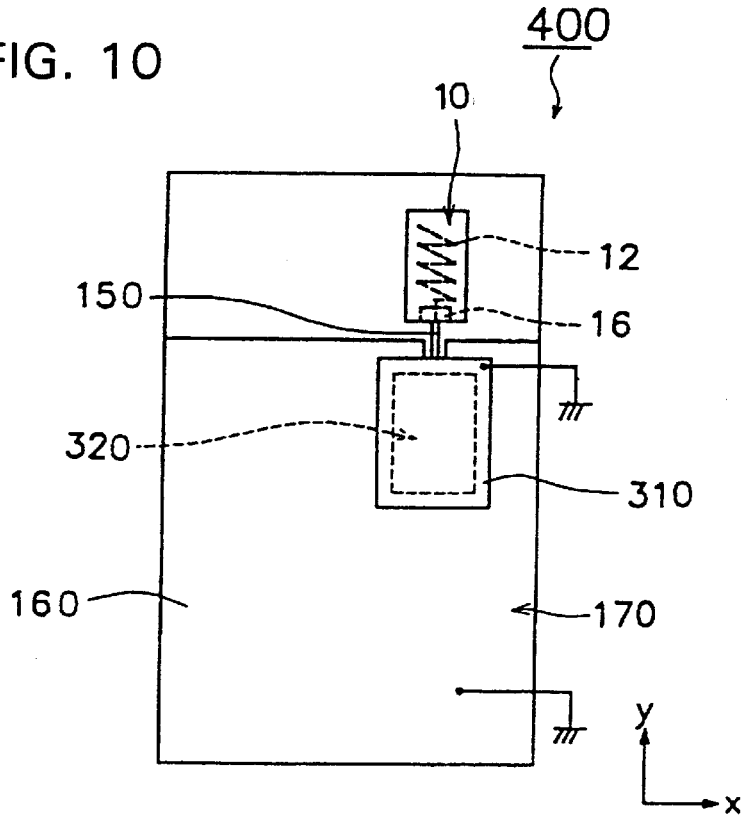
FIG. 10 is a top view of a third preferred embodiment relating to an antenna device of the present invention.
Figure 11:
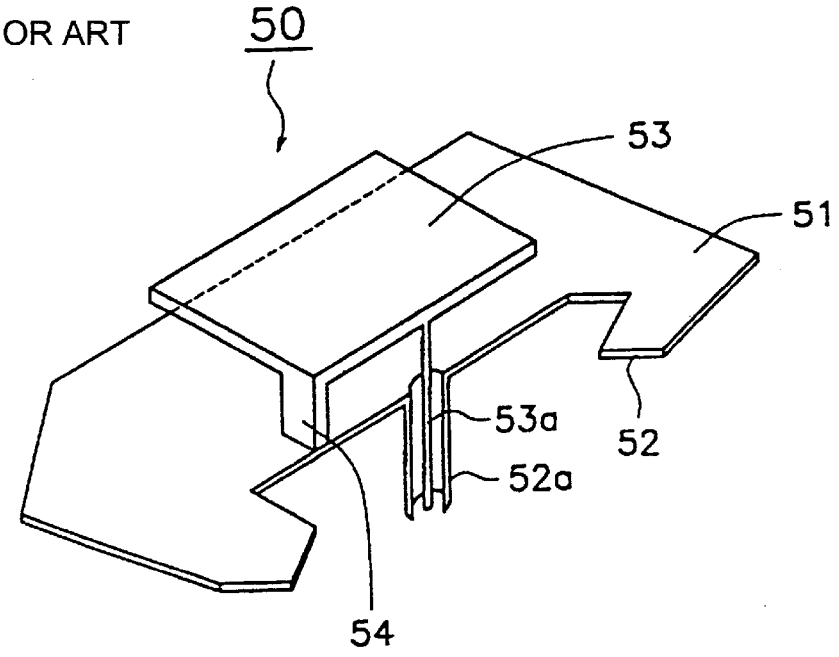
FIG. 11 PRIOR ART
FIG. 11 is a perspective view of a conventional inverted F-type antenna.

In FIG. 10, a top view of a third preferred embodiment of an antenna device according to the present invention is shown. The antenna device 400 is composed of an antenna unit 10 having a conductor 12 and a feeding electrode 16 with one end of the conductor 12 connected, a high-frequency circuit portion 320 with the feeding electrode 16 connected and with a ground portion 310 made of a chassis, and a mounting board 170 having a linear conductor pattern 150 formed by printing conductive material on the surface and a ground electrode 160 in substantially rectangular form.

Further, the antenna unit 10 and the high-frequency circuit portion 320 are mounted on the mounting board 330, and the feeding electrode 16 of the antenna unit 10 and the high-frequency circuit portion 320 are connected through the conductor pattern 150 on the surface of the mounting board 170. At this time, the ground electrode 160 on the surface of the mounting board 170 and the ground portion 310 of the high-frequency circuit portion 320 mounted on the mounting board 170 constitute a ground part resonant with the antenna unit 10. Furthermore, the length in the polarization direction of a radio wave (horizontally polarized wave: direction x in FIG. 10, vertically polarized wave: direction y in FIG. 10) of the ground electrode 160 on the surface of the mounting board 170 and the grounding portion 310 of the high-frequency circuit portion 320 both of which finction as the ground part, is more than λ/4 (λ: wavelength of a radio wave).

According to the antenna device 400, the antenna unit 10 comes to function as one pole of a dipole antenna, and the ground electrode 160 on the surface of the mounting board 170 and the grounding portion 310 of the high frequency circuit portion 320 which function as the ground part resonant with the antenna unit 10 as the other pole of the dipole antenna.

As described above, according to an antenna device of the first through third preferred embodiments, because an antenna unit and a ground part resonant with the antenna unit of the length of λ/4 in the polarization direction of a radio wave are provided, the antenna unit is able to act as one pole of a dipole antenna, and the ground part resonant with the antenna unit as the other pole of the dipole antenna.

According to the preferred embodiment of the invention, the body 11 can be made as shown in FIG. 2 or as shown in FIG. 6, or in other equivalent ways. If made as shown in FIG. 2, the first sheet 13*b*, second sheet 13*d* and at least one generally planar additional sheet 13*c* are laminated together to form an elongated structure wherein respective pairs of first and second conductors (14*a*–14*d*, 14*e*–14*h*) are coupled to one another through the at least one generally planar additional sheet 13*c* to form respective spiral loops of a spiral antenna so that a central axis of the spiral antenna extends generally parallel to a longitudinal direction of the elongated structure; each of the sheets being formed of a material having a permeability of $1<\mu<7$ or dielectric constant $\epsilon$ of $1<\epsilon<130$; and a feeding terminal 16 coupled to one end of the spiral antenna so that the antenna unit forms a mono-pole antenna, the antenna unit and the ground part together functioning as a dipole antenna . If made according to FIG. 6, the first and second generally planar sheets 19*a* and 19*b* are laminated together to form an elongated structure wherein respective pairs of the first and second conductors (20*a*–20*d*, 20*e*–20*h*) are coupled to one another to form respective spiral loops of a spiral antenna so that a central axis of the spiral antenna extends generally parallel to a longitudinal direction of the elongated structure; each of the sheets being formed of a material having a permeability of $1<\mu<7$ or a dielectric constant $\epsilon$ of $1<\epsilon<130$; and a feeding terminal 16*a* coupled to one end of the spiral antenna so that the antenna unit forms a mono-pole antenna, the antenna unit and the ground part together functioning as a dipole antenna.

Therefore, at a resonance point an antenna unit and a ground part are able to act as one pair of antennas like a dipole antenna. As the result, an antenna device having as high a gain as a dipole antenna is able to be obtained although it is small-sized.

In addition, radio equipment mounted with such a small-sized antenna device having a high gain becomes of small size and of a high gain.

Further, according to an antenna device of the first preferred embodiment, because the antenna device is able to be applied to an antenna device in which the power is supplied to the antenna unit from a power supply, an antenna device which is of small size and is more simplified is realized.

Furthermore, according to an antenna device of the second preferred embodiment, because the antenna device is able to be applied to an antenna device in which the power is supplied to the antenna unit from a high-frequency circuit portion such as a VCO, a switching circuit, etc., the antenna device is able to be mounted on a radio equipment as it is, and as a result, the manufacturing processes of the radio equipment are made simplified.

Moreover, according to an antenna device of the second preferred embodiment, because a ground electrode on the surface of a mounting board to mount an antenna unit and a ground portion of a high-frequency circuit portion constitute a ground part resonant with the antenna unit, even if the antenna device has been made of small size, the length in the polarization direction of a radio wave of the ground part resonant with the antenna unit comes to satisfy the condition of about $\lambda/4$ or more. Therefore, the antenna device becomes further small-sized and a radio equipment mounted with this antenna device is able to become of small size.

Moreover, in an antenna device according to the first and third preferred embodiments, the cases in which the ground electrode on the surface of the mounting board is nearly of a rectangular form were explained, but if the length in the polarization direction of a radio wave satisfies the condition of more than $\lambda/4$, the same effect can be obtained under a ground electrode of whatever form.

Moreover, in an antenna device according to the second and third preferred embodiments, the cases in which the ground portion of the high-frequency circuit portion is made of a metal chassis were explained, but if the length in the polarization of a radio wave satisfies the condition of more than $\lambda/4$, the same effect can be obtained whatever ground electrode is formed in the high-frequency circuit portion.

Furthermore, the cases in which the basic body of the chip-antenna is made of dielectric material having barium oxide, aluminum oxide, silica as its main components were explained, but the material of the basic body is not limited to them. Even if a dielectric material having titanium oxide and neodymium oxide as its main components, a magnetic material having nickel, cobalt, and iron as its main components, or a combination of dielectric material and magnetic material is used, the same effect can be obtained.

Moreover, although one embodiment set forth above illustrates a conductor formed inside the base member, the conductor may be formed by coiling the conductive patterns on the surface of the base member and/or inside the base member. Alternatively, a conductor may be formed by forming a spiral groove on the surface of the base member and coiling a wire material, such as a plated wire or enameled wire, along the groove, or a conductor may be meanderingly formed on the surface of the base member and/or inside the base member.

The feeding terminal is essential for the practice of the embodiment in accordance with the present invention.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An antenna device, comprising:

an antenna unit including: a basic body comprising at least one of dielectric ceramic and magnetic ceramic, at least one conductor disposed at least one of inside and on a surface of the basic body, and a feeding electrode for applying a voltage to the conductor, disposed on the surface of the basic body;

a mounting board on which said antenna unit is mounted;

a ground part in association with said mounting board and adapted to resonate with said antenna unit; and a length in the polarization direction of a radio wave of said ground part being about $\lambda/4$ or more, where $\lambda$ is a wavelength of the radio wave, said basic body comprising;

a first generally planar sheet having a plurality of spaced, first conductors formed on one major surface thereof, a second generally planar sheet having a plurality of spaced second conductors formed on one major surface thereof;

said first and second generally planar sheets being laminated together to form an elongated structure wherein respective pairs of said first and second conductors are coupled to one another to form respective spiral loops of a spiral antenna so that a central axis of said spiral antenna extends generally parallel to a longitudinal direction of said elongated structure;

each of said sheets being formed of a material having a relative permeability of $1<\mu<7$ or a dielectric constant $\epsilon$ of $1<\epsilon<130$; and a feeding terminal coupled to one end of said spiral antenna so that said antenna unit forms a mono-pole antenna, said antenna unit and ground part together functioning as a dipole antenna.

2. The antenna device of claim 1, further comprising at least one generally planar additional sheet located between the first and second generally planar sheets, and wherein respective pairs of said first and second conductors are coupled together through said at least one generally planar additional sheet.

3. The antenna device of claim 2, wherein the at least one generally planar additional sheet has conductive through holes for coupling said first and second conductors.

4. The antenna device of claim 1, wherein said ground part comprises at least one of a ground electrode disposed on said mounting board and a ground portion of a high-frequency circuit portion mounted on said mounting board together with said antenna unit.

5. An antenna device, comprising:

an antenna unit including: a basic body comprising at least one of dielectric ceramic and magnetic ceramic, at least one conductor disposed at least one of inside and on a surface of the basic body, and a feeding electrode for applying a voltage to the conductor, disposed on the surface of the basic body;

a mounting board on which said antenna unit is mounted;

a ground part in association with said mounting board and adapted to resonate with said antenna unit; and a length in the polarization direction of a radio wave of said ground part being about $\lambda/4$ or more, where $\lambda$ is a wavelength of the radio wave, said basic body comprising;

a first generally planar sheet having a plurality of spaced, first conductors formed on one major surface thereof, a second generally planar sheet having a plurality of spaced second conductors formed on one major surface thereof;

at least one generally planar additional sheet located between the first and second generally planar sheets;

said first and second generally planar sheets being laminated together to form an elongated structure wherein respective pairs of said first and second conductors are coupled together through said at least one generally planar additional sheet to form respective spiral loops of a spiral antenna so that a central axis of said spiral antenna extends generally parallel to a longitudinal direction of said elongated structure;

each of said sheets being formed of a material having a relative permeability of $1<\mu<7$; and a feeding terminal coupled to one end of said spiral antenna so that said antenna unit forms a mono-pole antenna, said antenna unit and ground part together functioning as a dipole antenna.

6. The antenna device of claim 5, wherein the at least one generally planar additional sheet has conductive through holes for coupling said first and second conductors.

7. The antenna device of claim 5, wherein said ground part comprises at least one of a ground electrode disposed on said mounting board and a ground portion of a high-frequency circuit portion mounted on said mounting board together with said antenna unit.

* * * * *